United States Patent [19]

Malm et al.

[11] 4,139,794

[45] Feb. 13, 1979

[54] WEDGE-PIN GLASS HALOGEN LAMP WITH TRANSVERSE REFERENCE FEATURE

[75] Inventors: Robert N. Malm; Charles W. Cox, both of Willoughby, Ohio

[73] Assignee: General Electric Company, Schenectady, N.Y.

[21] Appl. No.: 906,177

[22] Filed: May 15, 1978

Related U.S. Application Data

[63] Continuation of Ser. No. 745,045, Nov. 26, 1976, abandoned.

[51] Int. Cl.[2] ..... H01K 1/28

[52] U.S. Cl. ..... 313/220; 313/290; 313/318

[58] Field of Search ..... 313/220, 285, 290, 318, 313/332

[56] References Cited

U.S. PATENT DOCUMENTS

| | | | |
|---|---|---|---|
| 2,664,517 | 12/1953 | Wiener | 313/220 X |
| 2,999,180 | 9/1961 | Howles et al. | 313/318 |
| 3,243,634 | 3/1966 | Mosby | 313/285 |
| 3,270,237 | 8/1966 | Danko | 313/220 |
| 3,798,491 | 3/1974 | Malm | 313/220 X |

*Primary Examiner*—Craig E. Church
*Assistant Examiner*—Charles F. Roberts
*Attorney, Agent, or Firm*—Paul F. Wille; Lawrence R. Kempton; Frank L. Neuhauser

[57] ABSTRACT

A glass halogen, miniature incandescent lamp comprises at least two conductive pins for electrical contact and a molded seal area for secure mechanical contact in a socket.

3 Claims, 1 Drawing Figure

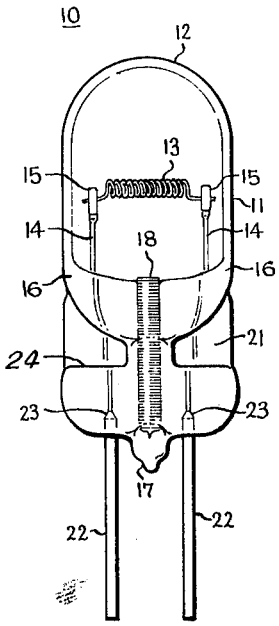
10
12
13
15
15
11
14
14
18
16
16
21
24
23
23
17
22
22

WEDGE-PIN GLASS HALOGEN LAMP WITH TRANSVERSE REFERENCE FEATURE

This is a continuation of application Ser. No. 745,045, filed Nov. 26, 1976, now abandoned, assigned to the assignee of the present invention.

BACKGROUND OF THE INVENTION

This invention relates to glass halogen lamps and, in particular, to such lamps having reference features molded into the seal area thereof and contact pins attached to the lead wires and extending from the seal area.

In the prior art, baseless or all-glass lamps provided an economic alternative to based lamps for the automotive industry and others. The tungsten-halogen cycle was successfully applied to a broader range of lamps, improving the efficacy and lumen maintenance thereof. As described in U.S. Pat. No. 3,798,491, low cost miniature halogen lamps were realized through the substitution of a particular glass for quartz and the elimination of foliated lead wires.

Any advance in the art usually generates a new set of problems to be solved. As known by those of skill in the art, halogen cycle lamps require higher bulb wall temperatures than non-halogen cycle lamps. In particular, glass halogen lamps are characterized by high temperatures in the seal area during operation. In the past, these lamps have been based, e.g., with a ceramic pin base, to insulate the contact pins from the glass and to encapsulate the molybdenum lead wires to prevent oxidation thereof.

A pin base lamp, while affording good electrical contact, may not have adequate retention in the socket for vibration applications. In the past, wedge base lamps (non-halogen cycle) have been used in vibration applications. Contact is usually made to a wedge base lamp by socket spring terminals which press the lead wire against the seal area. Because of the high operating temperature in the seal area, wedge base glass halogen lamps may be subject to oxidized lead wires and poor electrical contact.

SUMMARY OF THE INVENTION

In view of the foregoing, it is therefore an object of the present invention to provide an easily inserted yet mechanically secure glass halogen lamp.

A further object of the present invention is to provide a baseless glass halogen lamp having reliable electrical contact, over the life of the lamp, between the lamp leads and the socket contacts.

Another object of the present invention is to provide a vibration tolerant pin base lamp.

A further object of the present invention is to provide a wedge base lamp which can fit existing pin base sockets.

The foregoing objects are achieved in the present invention wherein contact pins are attached to the lead wires within the seal area while the seal area itself contains molded reference features for mechanically securing the lamp in a socket.

BRIEF DESCRIPTION OF THE DRAWING

A more complete understanding of the present invention can be obtained by considering the following detailed description in conjunction with the accompanying drawing, in which:

The FIGURE illustrates a preferred embodiment of a wedge-pin glass halogen lamp in accordance with the present invention.

DESCRIPTION OF THE PREFERRED EMBODIMENTS

Referring to the drawing, lamp 10 comprises a glass envelope 11 having a rounded end 12 and a pinch end. Inside the envelope, filament 13 is connected to lead wires 14 by hook or clamp 15. Lead wires 14 preferably comprise a refractory metal such as molybdenum or tungsten. As described in U.S. Pat. No. 3,798,491, lead wires 14 are sealed to the hard or high temperature glass envelope 11 at seal area 16. The lamp is flushed and filled with a halide gas mixture by way of exhaust tube 18 which is maintained open while the seal is molded by a coil of tungsten or other refractory metal. The lamp is then sealed or tipped-off at 17.

In accordance with the present invention, glass halogen lamp 10 comprises a wedge base having a reference feature pressed into the sealed or pinch end of the lamp. This reference feature, extending transversely to the pinch end of the lamp, may comprise a depression, such as depression 21 or a ridge, such as ridge 24. Filament 13 may be located with respect to reference feature 21 thereby providing the optical capabilities of a wedge base lamp. Lead wires 14 are connected to contact pins 22, for example by butt welding as illustrated by weld 23. Conductive pins 22 may comprise any suitable material such as platinum-plated molybdenum or nickel-plated iron, either of which are relatively stiff and corrosion resistant. Weld 23 is preferably within the glass forming the pinch end of lamp 10 to effectively remove the joint from contact with the atmosphere, thereby providing a more corrosion-resistant lamp as well as mechanically supporting contact pins 22. While shown as extending from the seal area of the lamp in a direction parallel to the axis of the lamp, pins 22 may be bent at any desired angle, outside the seal area, to provide, in effect, a side contact lamp.

There is thus provided by the present invention a vibration tolerant, glass halogen lamp suitable for use in applications requiring accurate location of the filament, but without the need for a separate base. In addition, the reliability of the electrical contact with the lamp is improved over that obtained with a wedge base lamp.

Having thus described the invention, it will be apparent to those of skill in the art that various modifications may be made within the spirit and scope of the present invention. For example, while the FIGURE illustrates a single filament, glass halogen lamp, the present invention applies equally well to multiple filament, glass halogen lamps. Also, the reference feature may comprise one or more depressions or a suitable ridge, depending upon the construction of the socket. While pins 22 may be any suitable length, it is also contemplated by the present invention to utilize contact pins having a specified length such that the pins reach a stop in the socket, thereby precisely locating filament 13. In this alternative, the pins determine the location of the filament while the wedge base reference features provide mechanical security.

What we claim as new and desire to secure by Letters Patent of the United States is:

1. A glass-halogen incandescent lamp comprising:

an envelope comprising an aluminosilicate glass and having a rounded end and a sealed end;

at least one refractory metal filament positioned within said envelope;

at least two lead wires, each having a first and a second end, the first ends of which are connected to said filament;

a fill gas comprising a halide;

at least two contact pins, each having a first and a second end, the first end of each being welded to respective second ends of said lead wires, said first ends of said contact pins being located within the glass comprising said sealed end; said contact pins being of a predetermined length for locating the filament with respect to said second ends of said contact pins, said second ends of said contact pins being outside said lamp; and a transverse reference feature in said sealed end by which said lamp may be securely held.

2. The lamp as set forth in claim 1 wherein said reference feature comprises a depression in said sealed end.

3. The lamp as set forth in claim 1 wherein said reference feature comprises a ridge in said sealed end.

* * * * *